US011329382B1

(12) United States Patent
Lo et al.

(10) Patent No.: US 11,329,382 B1
(45) Date of Patent: May 10, 2022

(54) ANTENNA STRUCTURE

(71) Applicant: Quanta Computer Inc., Taoyuan (TW)

(72) Inventors: Wen-Yuan Lo, Taoyuan (TW); Hui Lin, Taoyuan (TW); Jui-Chun Jao, Taoyuan (TW); Chen-An Lu, Taoyuan (TW)

(73) Assignee: QUANTA COMPUTER INC., Taoyuan (TW)

( * ) Notice: Subject to any disclaimer, the term of this patent is extended or adjusted under 35 U.S.C. 154(b) by 59 days.

(21) Appl. No.: 17/098,647

(22) Filed: Nov. 16, 2020

(30) Foreign Application Priority Data

Oct. 22, 2020 (TW) ..... 109136575

(51) Int. Cl.
*H01Q 5/35* (2015.01)
*H01Q 1/24* (2006.01)
*H01Q 9/42* (2006.01)

(52) U.S. Cl.
CPC ..... *H01Q 5/35* (2015.01); *H01Q 1/243* (2013.01); *H01Q 9/42* (2013.01)

(58) Field of Classification Search
CPC ..... H01Q 9/42; H01Q 1/243; H01Q 5/35
See application file for complete search history.

(56) References Cited

U.S. PATENT DOCUMENTS 9,899,725 B2 2/2018 Soliman et al.

OTHER PUBLICATIONS

Chinese language office action dated Jun. 10, 2021, issued in application No. TW 109136575.

*Primary Examiner* — Graham P Smith
(74) *Attorney, Agent, or Firm* — McClure, Qualey & Rodack, LLP

(57) ABSTRACT

An antenna structure includes a first radiation element, a second radiation element, a third radiation element, a fourth radiation element, a fifth radiation element, and a dielectric substrate. The first radiation element has a positive feeding point. The second radiation element is coupled to the first radiation element. The third radiation element has a negative feeding point. The fourth radiation element is coupled to the third radiation element. The fifth radiation element is floating. The dielectric substrate has a first surface and a second surface which are opposite to each other. The first radiation element and the third radiation element are both disposed on the first surface of the dielectric substrate. The second radiation element, the fourth radiation element, and the fifth radiation element are all disposed on the second surface of the dielectric substrate.

10 Claims, 5 Drawing Sheets

ANTENNA STRUCTURE

CROSS REFERENCE TO RELATED APPLICATIONS

This application claims priority of Taiwan Patent Application No. 109136575 filed on Oct. 22, 2020, the entirety of which is incorporated by reference herein.

BACKGROUND OF THE INVENTION

Field of the Invention

The disclosure generally relates to an antenna structure, and more particularly, it relates to a wideband antenna structure with a small size.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, 2500 MHz, and 2700 MHz. Some devices cover a small wireless communication area; these include mobile phones using Wi-Fi and Bluetooth systems and using frequency bands of 2.4 GHz, 5.2 GHz, and 5.8 GHz.

Antennas are indispensable elements for wireless communication. If an antenna used for signal reception and transmission has insufficient bandwidth, it will negatively affect the communication quality of the mobile device. Accordingly, it has become a critical challenge for antenna designers to design a small-size, wideband antenna element.

BRIEF SUMMARY OF THE INVENTION

In an exemplary embodiment, the disclosure is directed to an antenna structure that includes a first radiation element, a second radiation element, a third radiation element, a fourth radiation element, a fifth radiation element, and a dielectric substrate. The first radiation element has a positive feeding point. The second radiation element is coupled to the first radiation element. The third radiation element has a negative feeding point. The fourth radiation element is coupled to the third radiation element. The fifth radiation element is floating. The dielectric substrate has a first surface and a second surface which are opposite to each other. The first radiation element and the third radiation element are both disposed on the first surface of the dielectric substrate. The second radiation element, the fourth radiation element, and the fifth radiation element are all disposed on the second surface of the dielectric substrate.

In some embodiments, the antenna structure further includes a first conductive via element and a second conductive via element. The first conductive via element penetrates the dielectric substrate. The second radiation element is coupled through the first conductive via element to the first radiation element. The second conductive via element penetrates the dielectric substrate. The fourth radiation element is coupled through the second conductive via element to the third radiation element.

In some embodiments, the first radiation element substantially has a straight-line shape, and the second radiation element substantially has a long L-shape.

In some embodiments, the third radiation element substantially has a U-shape, and the fourth radiation element substantially has a short L-shape.

In some embodiments, the fifth radiation element substantially has a T-shape and includes a wide portion and a narrow portion.

In some embodiments, the positive feeding point and the negative feeding point have vertical projections on the second surface of the dielectric substrate, and the vertical projections are inside the wide portion of the fifth radiation element.

In some embodiments, the antenna structure covers a first frequency band and a second frequency band. The first frequency band is from 2400 MHz to 2500 MHz. The second frequency band is from 5150 MHz to 5850 MHz.

In some embodiments, the total length of the first radiation element and the second radiation element is shorter than or equal to 0.25 wavelength of the first frequency band.

In some embodiments, the total length of the third radiation element and the fourth radiation element is shorter than or equal to 0.25 wavelength of the first frequency band.

In some embodiments, the antenna structure further includes a coaxial cable which includes a central conductive line and a conductive housing. The central conductive line is coupled to the positive feeding point. The conductive housing is coupled to the negative feeding point. The length of the coaxial cable is shorter than or equal to 50 mm.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail below.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1:
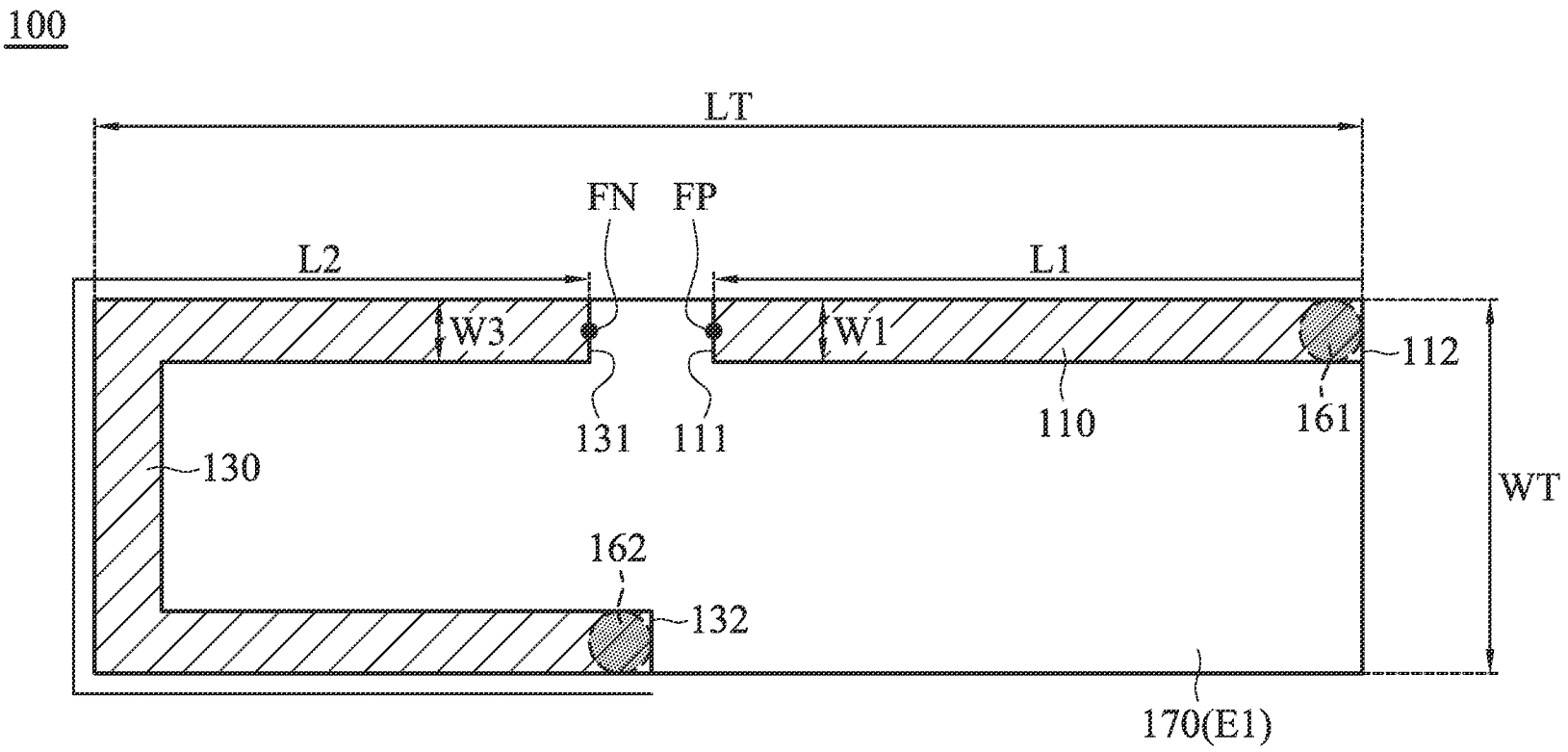
FIG. 1 is a front view of an antenna structure according to an embodiment of the invention.
Figure 2:
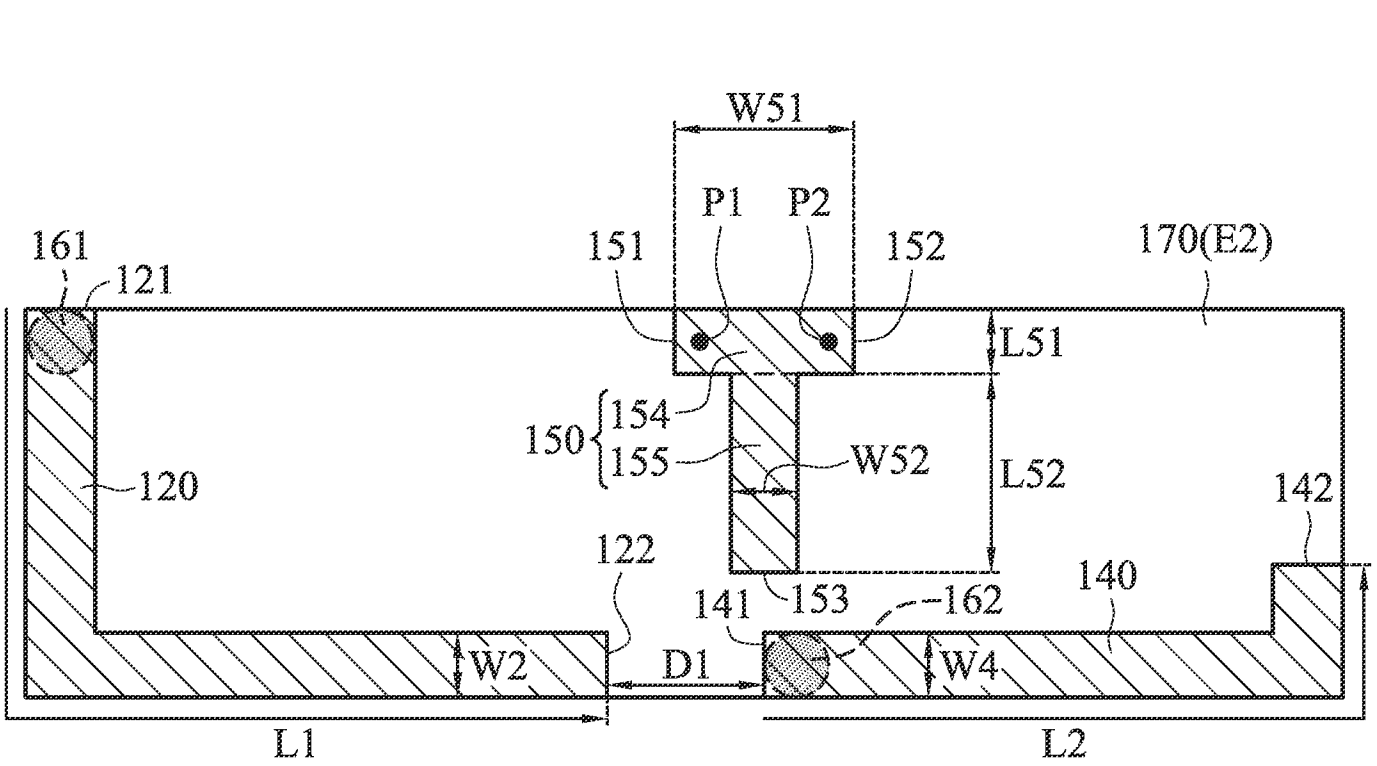
FIG. 2 is a back view of an antenna structure according to an embodiment of the invention.

FIG. 1 is a front view of an antenna structure 100 according to an embodiment of the invention. FIG. 2 is a back view of the antenna structure 100 according to an embodiment of the invention (Compared with the front view, the antenna structure 100 is rotated by 180 degrees). The antenna structure 100 may be applied to a mobile device, such as a joystick, a smart phone, a tablet computer, or a notebook computer. In the embodiment of FIG. 1, the antenna structure 100 at least includes a first radiation element 110, a second radiation element 120, a third radiation element 130, a fourth radiation element 140, a fifth radiation element 150, and a dielectric substrate 170. The first radiation element 110, the second radiation element 120, the third radiation element 130, the fourth radiation element 140, and the fifth radiation element 150 may all be made of metal materials, such as silver, copper, aluminum, iron, or their alloys.

The dielectric substrate 170 may be an FR4 (Flame Retardant 4) substrate, a PCB (Printed Circuit Board), or an FCB (Flexible Circuit Board). The dielectric substrate 170 has a first surface E1 and a second surface E2 which are opposite to each other. The first radiation element 110 and the third radiation element 130 are both disposed on the first surface E1 of the dielectric substrate 170. The second radiation element 120, the fourth radiation element 140, and the fifth radiation element 150 are all disposed on the second surface E2 of the dielectric substrate 170.

The first radiation element 110 may substantially have a straight-line shape. Specifically, the first radiation element 110 has a first end 111 and a second end 112. A positive feeding point FP is positioned at the first end 111 of the first radiation element 110. The positive feeding point FP may be further coupled to a positive electrode of a signal source 190. For example, the signal source 190 may be an RF (Radio Frequency) module for exciting the antenna structure 100.

The second radiation element 120 may substantially have a relatively long L-shape, which may be partially perpendicular to and partially parallel to the first radiation element 110. Specifically, the second radiation element 120 has a first end 121 and a second end 122. The first end 121 of the second radiation element 120 is coupled to the second end 112 of the first radiation element 110. The second end 122 of the second radiation element 120 is an open end. The first end 111 of the first radiation element 110 and the second end 122 of the second radiation element 120 may substantially extend in the same direction.

In some embodiments, the antenna structure 100 further includes a first conductive via element 161. For example, the first conductive via element 161 may be adjacent to a corner of the dielectric substrate 170. The first conductive via element 161 penetrates the dielectric substrate 170. The first conductive via element 161 is coupled between the second end 112 of the first radiation element 110 and the first end 121 of the second radiation element 120. It should be noted that the term "adjacent" or "close" over the disclosure means that the distance (spacing) between two corresponding elements is smaller than a predetermined distance (e.g., 5 mm or shorter), or means that the two corresponding elements are touching each other directly (i.e., the aforementioned distance/spacing therebetween is reduced to 0).

The third radiation element 130 may substantially have a U-shape. Specifically, the third radiation element 130 has a first end 131 and a second end 132. A negative feeding point FN is positioned is positioned at the first end 131 of the third radiation element 130. The negative feeding point FN is separate from and opposite to the positive feeding point FP. The negative feeding point FN may be further coupled to a negative electrode of the signal source 190. The first end 131 and the second end 132 of the third radiation element 130 may be substantially extend in the same direction.

The fourth radiation element 140 may substantially have a relatively short L-shape (it is shorter than the second radiation element 120). Specifically, the fourth radiation element 140 has a first end 141 and a second end 142. The first end 141 of the fourth radiation element 140 is coupled to the second end 132 of the third radiation element 130. The second end 142 of the fourth radiation element 140 is an open end. In some embodiments, the fourth radiation element 140 has a vertical projection on the first surface E1 of the dielectric substrate 170, and the vertical projection at least partially overlaps the third radiation element 130.

In some embodiments, the antenna structure 100 further includes a second conductive via element 162. For example, the second conductive via element 162 may be adjacent to a bottom edge of the dielectric substrate 170. The second conductive via element 162 penetrates the dielectric substrate 170. The second conductive via element 162 is coupled between the second end 132 of the third radiation element 130 and the first end 141 of the fourth radiation element 140.

The fifth radiation element 150 may substantially have a T-shape. Specifically, the fifth radiation element 150 has a first end 151, a second end 152, and a third end 153, which are three open ends. The first end 151 and the second end 152 of the fifth radiation element 150 may extend in opposite directions away from each other. It should be noted that the fifth radiation element 150 is floating and does not directly touch any other radiation element. The fifth radiation element 150 includes a wide portion 154 and a narrow portion 155. In some embodiments, the positive feeding point FP has a first vertical projection P1 on the second surface E2 of the dielectric substrate 170, and the negative feeding point FN has a second vertical projection P2 on the second surface E2 of the dielectric substrate 170. Both the first vertical projection P1 and the second vertical projection P2 are inside the wide portion 154 of the fifth radiation element 150. The first vertical projection P1 is adjacent to the first end 151 of the fifth radiation element 150. The second vertical projection P2 is adjacent to the second end 152 of the fifth radiation element 150.

Figure 3:
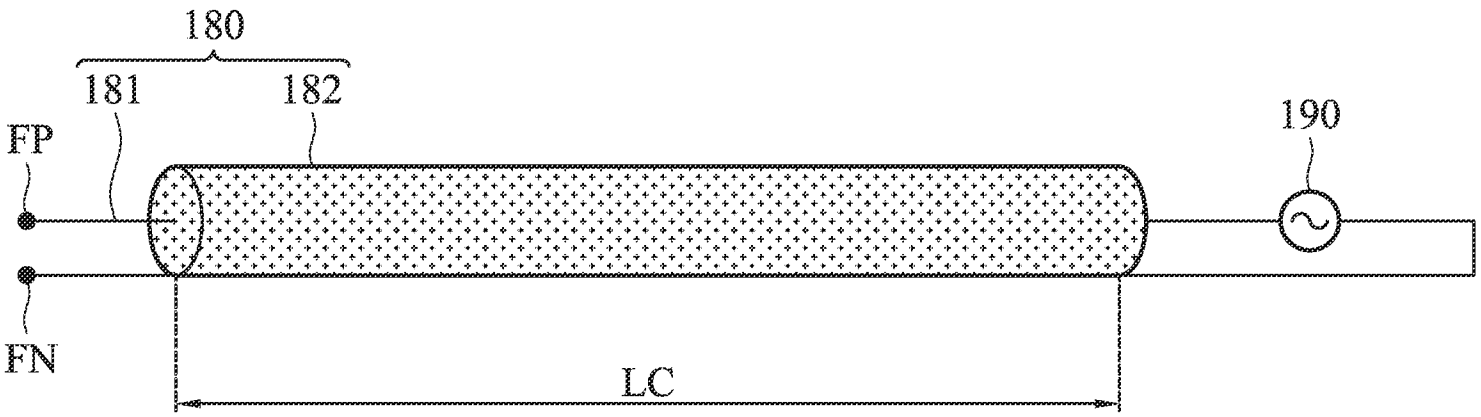
FIG. 3 is a view of a coaxial cable according to an embodiment of the invention.

In some embodiments, the antenna structure 100 further includes a coaxial cable 180. FIG. 3 is a view of the coaxial cable 180 according to an embodiment of the invention. In the embodiment of FIG. 3, the coaxial cable 180 includes a central conductive line 181 and a conductive housing 182. The positive electrode of the signal source 190 is coupled through the central conductive line 181 to the positive feeding point FP. The negative electrode of the signal source 190 is coupled through the conductive housing 182 to the negative feeding point FN.

Figure 4:
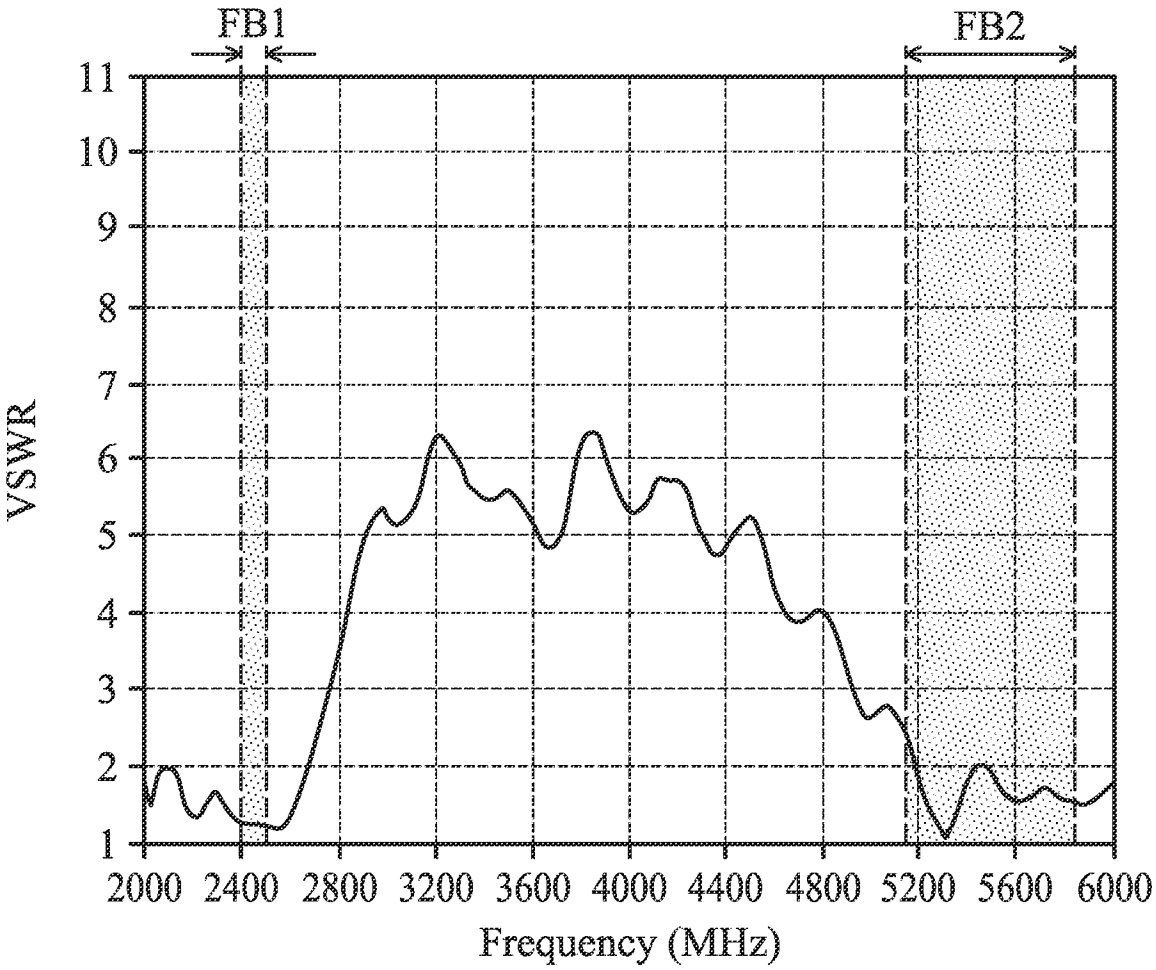
FIG. 4 is a diagram of VSWR (Voltage Standing Wave Ratio) of an antenna structure according to an embodiment of the invention.

FIG. 4 is a diagram of VSWR (Voltage Standing Wave Ratio) of the antenna structure 100 according to an embodiment of the invention. The horizontal axis represents the operation frequency (MHz), and the vertical axis represents the VSWR. According to the measurement of FIG. 4, when being excited by the signal source 190, the antenna structure 100 can cover a first frequency band FB1 and a second frequency band FB2. For example, the first frequency band FB1 may be from 2400 MHz to 2500 MHz, and the second frequency band FB2 may be from 5150 MHz to 5850 MHz. Accordingly, the antenna structure 100 can support at least the wideband operations of WLAN (Wireless Local Area Networks) 2.4 GHz/5 GHz.

With respect to the antenna theory, the first radiation element 110, the second radiation element 120, the third radiation element 130, and the fourth radiation element 140 are excited to generate a fundamental resonant mode, thereby forming the aforementioned first frequency band FB1. The first radiation element 110, the second radiation element 120, the third radiation element 130, and the fourth radiation element 140 are further excited to generate a higher-order mode (double-frequency effect), thereby forming the aforementioned second frequency band FB2. In addition, the incorporation of the fifth radiation element 150 can increase the coupling amount between the first radiation element 110 and the third radiation element 130. According to practical measurements, such a design can fine-tune the impedance matching of the antenna structure 100. Since it is not necessary to design a relatively large system ground plane, the antenna structure 100 not only reduces the total size but also supports the desired wideband operations.

In some embodiments, the element sizes of the antenna structure 100 are described as follows. The total length L1 of the first radiation element 110 and the second radiation element 120 may be shorter than or equal to 0.25 wavelength (λ/4) of the first frequency band FB1 of the antenna structure 100. The width W1 of the first radiation element 110 may be from 1 mm to 2 mm. The width W2 of the second radiation element 120 may be from 1 mm to 2 mm. The total length L2 of the third radiation element 130 and the fourth radiation element 140 may be shorter than or equal to 0.25 wavelength (λ/4) of the first frequency band FB1 of the antenna structure 100. The width W3 of the third radiation element 130 may be from 1 mm to 2 mm. The width W4 of the fourth radiation element 140 may be from 1 mm to 2 mm. In the fifth radiation element 150, the ratio (W51/W52) of the wide portion 154's width W51 to the narrow portion 155's width W52 may be about 3, and the ratio (L51/L52) of the wide portion 154's length L51 to the narrow portion 155's length L52 may be about 0.25. The distance D1 between the second end 122 of the second radiation element 120 and the first end 141 of the fourth radiation element 140 may be from 2 mm to 3 mm. The thickness of the dielectric substrate 170 (i.e., the distance between the first surface E1 and the second surface E2) may be about 0.4 mm. The total length LT of the antenna structure 100 may be about 20 mm. The total width WT of the antenna structure 100 may be about 6 mm. In order to reduce the transmission loss, the length LC of the coaxial cable 180 should be shorter than or equal to 50 mm. The above ranges of element sizes are calculated and obtained according to many experiment results, and they help to optimize the operation bandwidth and impedance matching of the antenna structure 100.

Figure 5:
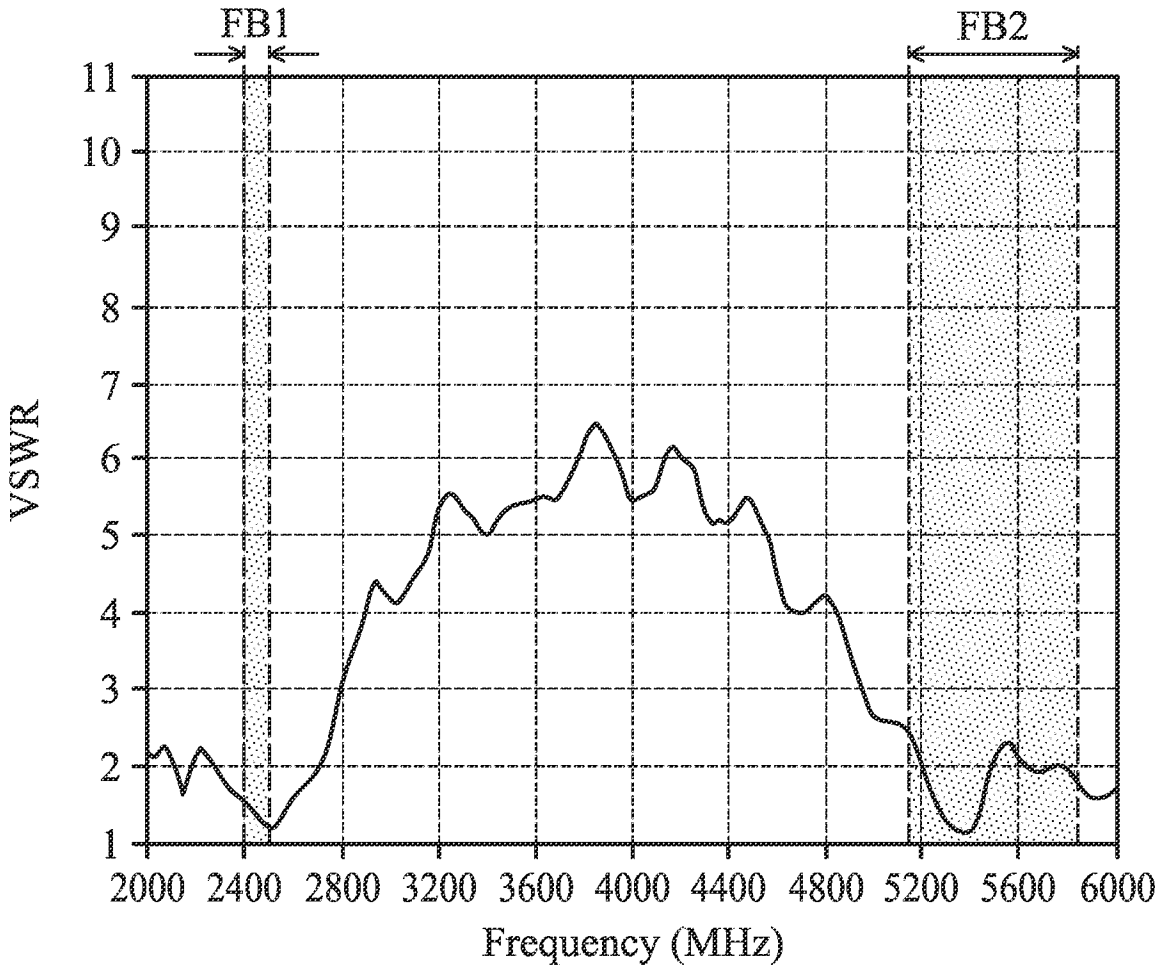
FIG. 5 is a diagram of VSWR of an antenna structure when it is held by a hand of a user, according to an embodiment of the invention.

FIG. 5 is a diagram of VSWR of the antenna structure 100 when it is held by a hand of a user, according to an embodiment of the invention. The horizontal axis represents the operation frequency (MHz), and the vertical axis represents the VSWR. According to the measurement of FIG. 5, even if the antenna structure 100 is very close to a human body, its operation frequency will not shift apparently. Thus, the antenna structure 100 can provide sufficient reliability.

The invention proposes a novel antenna structure. In comparison to the conventional design, the invention has at least the advantages of small size, wide bandwidth, low manufacturing cost, and high reliability, and therefore it is suitable for application in a variety of mobile communication devices.

Note that the above element sizes, element shapes, and frequency ranges are not limitations of the invention. An antenna designer can fine-tune these settings or values according to different requirements. It should be understood that the antenna structure of the invention is not limited to the configurations of FIGS. 1-5. The invention may merely include any one or more features of any one or more embodiments of FIGS. 1-5. In other words, not all of the features displayed in the figures should be implemented in the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

While the invention has been described by way of example and in terms of the preferred embodiments, it should be understood that the invention is not limited to the disclosed embodiments. On the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. An antenna structure, comprising:

a first radiation element, having a positive feeding point;

a second radiation element, coupled to the first radiation element;

a third radiation element, having a negative feeding point;

a fourth radiation element, coupled to the third radiation element;

a fifth radiation element, wherein the fifth radiation element is floating; and a dielectric substrate, having a first surface and a second surface opposite to each other;

wherein the first radiation element and the third radiation element are disposed on the first surface of the dielectric substrate;

wherein the second radiation element, the fourth radiation element, and the fifth radiation element are disposed on the second surface of the dielectric substrate.

2. The antenna structure as claimed in claim 1, further comprising:

a first conductive via element, penetrating the dielectric substrate, wherein the second radiation element is coupled through the first conductive via element to the first radiation element; and a second conductive via element, penetrating the dielectric substrate, wherein the fourth radiation element is coupled through the second conductive via element to the third radiation element.

3. The antenna structure as claimed in claim 1, wherein the first radiation element substantially has a straight-line shape, and the second radiation element substantially has a long L-shape.

4. The antenna structure as claimed in claim 1, wherein the third radiation element substantially has a U-shape, and the fourth radiation element substantially has a short L-shape.

5. The antenna structure as claimed in claim 1, wherein the fifth radiation element substantially has a T-shape and comprises a wide portion and a narrow portion.

6. The antenna structure as claimed in claim 5, wherein the positive feeding point and the negative feeding point have vertical projections on the second surface of the dielectric substrate, and the vertical projections are inside the wide portion of the fifth radiation element.

7. The antenna structure as claimed in claim 1, wherein the antenna structure covers a first frequency band and a second frequency band, the first frequency band is from 2400 MHz to 2500 MHz, and the second frequency band is from 5150 MHz to 5850 MHz.

8. The antenna structure as claimed in claim 7, wherein a total length of the first radiation element and the second radiation element is shorter than or equal to 0.25 wavelength of the first frequency band.

9. The antenna structure as claimed in claim 7, wherein a total length of the third radiation element and the fourth radiation element is shorter than or equal to 0.25 wavelength of the first frequency band.

10. The antenna structure as claimed in claim 1, further comprising:

a coaxial cable, comprising a central conductive line and a conductive housing, wherein the central conductive line is coupled to the positive feeding point, and the conductive housing is coupled to the negative feeding point;

wherein a length of the coaxial cable is shorter than or equal to 50 mm.

* * * * *